US007019701B2

(12) United States Patent
Ohno et al.

(10) Patent No.: US 7,019,701 B2
(45) Date of Patent: Mar. 28, 2006

(54) ANTENNA DEVICE MOUNTED ON VEHICLE

(75) Inventors: Sadao Ohno, Gunma (JP); Kazuki Katono, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 43 days.

(21) Appl. No.: 10/761,199

(22) Filed: Jan. 22, 2004

(65) Prior Publication Data

US 2004/0150572 A1 Aug. 5, 2004

(30) Foreign Application Priority Data

Jan. 23, 2003 (JP) ..... P2003-014762

(51) Int. Cl.
*H01Q 1/32* (2006.01)

(52) U.S. Cl. ..... 343/715; 343/713

(58) Field of Classification Search ..... 343/713, 343/850, 715, 712, 711; 361/290, 292
See application file for complete search history.

(56) References Cited

U.S. PATENT DOCUMENTS 4,089,817 A * 5/1978 Kirkendall ..... 343/713
5,099,251 A * 3/1992 Fisher ..... 343/715
5,896,110 A * 4/1999 Kojima ..... 343/715
6,486,841 B1 * 11/2002 Imahigashi ..... 343/715

FOREIGN PATENT DOCUMENTS

| | | |
|---|---|---|
| EP | 0 862 239 | 9/1998 |
| EP | 1 152 479 | 11/2001 |
| EP | 1 286 414 | 2/2003 |
| FR | 2 584 871 | 5/1986 |
| JP | 2001-168645 A | 6/2001 |

* cited by examiner

*Primary Examiner*—Tuyet Vo
*Assistant Examiner*—Jimmy Vu
(74) *Attorney, Agent, or Firm*—Morgan Lewis & Bockius LLP

(57) ABSTRACT

An antenna device is mounted on a vehicle body. A distal end of an antenna element is attached to an antenna base. The antenna base is provided with a conductive screw projection electrically connected with the antenna element and inserted into a hole formed in the vehicle body, and a first insulative member mounted on an outer face of the vehicle body to electrically insulate the screw projection from the vehicle body. A conductive washer is disposed inside the vehicle body such that the screw projection is inserted therethrough. A conductive nut is disposed inside the vehicle body to be screwed to the screw projection to form a conductive path from the antenna element and an electric equipment disposed inside the vehicle. A second insulative member is disposed inside the vehicle body to electrically insulate the screw projection from the washer, and to electrically insulate the nut from the washer.

9 Claims, 8 Drawing Sheets

ANTENNA DEVICE MOUNTED ON VEHICLE

BACKGROUND OF THE INVENTION

The present invention relates to an antenna device to be mounted on a roof or the like of a vehicle.

Japanese Patent Publication No. 2001-168615A discloses an antenna device in which an antenna base on which a proximal end of an antenna element is disposed is fixed on a vehicle body such as a roof, by inserting a mount screw projected from the antenna base into a mount hole formed in the vehicle body, and screwing a nut to the mount screw via a pawl washer to fasten the antenna base onto the vehicle body. Incidentally, a pawl of the pawl washer bites an inner face of the vehicle body to ground the mount screw to the vehicle body while preventing the nut from being loosened.

In the above structure, the mount screw is provided as a hollow member through which a cable is inserted, so that an antenna signal of the antenna element is input or output via the cable.

Accordingly, in order to mount such an antenna device onto the vehicle body, it is necessary to conduct a fixing operation of the cable in addition to the fastening operation of the mount screw and the nut.

SUMMARY OF THE INVENTION

It is therefore an object of the invention to provide an antenna device capable of being fixed on a vehicle body only by the fastening operation of a mount screw and a nut, without providing a cable.

In order to achieve the above object, according to the invention, there is provided an antenna device mounted on a vehicle body, comprising:

an antenna element;

an antenna base, to which a distal end of the antenna element is attached, the antenna base comprising:

a conductive screw projection, electrically connected with the antenna element and inserted into a hole formed in the vehicle body;

a first insulative member, mounted on an outer face of the vehicle body to electrically insulate the screw projection from the vehicle body;

a conductive washer, disposed inside the vehicle body such that the screw projection is inserted therethrough;

a conductive nut, disposed inside the vehicle body to be screwed to the screw projection to form a conductive path from the antenna element and an electric equipment disposed inside the vehicle; and a second insulative member, disposed inside the vehicle body to electrically insulate the screw projection from the washer, and to electrically insulate the nut from the washer.

In such a configuration, since a signal path of the antenna signal is constituted by the screw projection for fixing the antenna base to the vehicle body, a cable for inputting/outputting the antenna signal is not required. Accordingly, the antenna device can be fixed by simple operation of screwing the nut to the screw projection.

Preferably, the screw projection is inserted through the washer such that relative rotation therebetween is restricted. Here, the first insulative member comprises a projection brought into contact with the outer face of the vehicle body, and the washer comprises a pawl arranged so as to oppose the projection through the vehicle body.

In such a configuration, since the circumferential position of the washer relative to the first insulative member is made stable, the projection and the pawl can be positively opposed to each other. The vehicle body held between the pawl and the projection can be prevented from being inadvertently deformed.

Here, it is preferable that the antenna base comprises a conductive member which is continuous with the screw projection and integrally molded with the first insulative member such that the projection is arranged between the conductive member and the vehicle body.

In such a configuration, since the compressive force due to the fastening operation acting on the projection is received by the conductive member, the shear stress acting on the projection is reduced. Accordingly, the mechanical strength of the projection can be enhanced.

It is also preferable that the first insulative member comprises a rubber pad mounted on the outer face of the vehicle body and formed with a hole, through which the projection extends.

In such a configuration, the rubber pad for preventing rain water or the like from invading the inside of the vehicle body is not deformed by the fastening operation of the nut. Further, since the fastening pressure of the nut is received by the projection, the positive fixation of the antenna device can be secured.

Preferably, the antenna device further comprises a conductive shield case having a wall interposed between the washer and the second insulative member and formed with a hole into which the screw projection is inserted. Here, the washer and the shield case are electrically connected. The nut is screwed to the screw projection at the inside of the shield case. The screw projection and the shield case are electrically insulated by the second insulative member.

In such a configuration, since the shield case is attached to the screw projection at the inside of the vehicle body, in a case where required circuit elements are housed in the shield case, the dimension of a part provided at the outside of the vehicle body can be downsized. Further, since it is established a coaxial structure in which the screw projection serves as a core conductor and the washer serves as an outer conductor, it is prevented external noise from mixing with the antenna signal.

Here, it is preferable that: the second insulative member is formed with a hole into which the screw projection is inserted; and the screw projection and the hole of the second insulative member are so formed as to restrict relative rotation therebetween.

In such a configuration, the circumferential position of the washer relative to the screw projection can be restricted by the second insulative member. Accordingly, the pawl of the washer can be positively opposed the projection of the first insulative member.

It is also preferable that the antenna device further comprises a conductive plate held by the second insulative member and the nut.

In such a configuration, the screw projection and the conductive plate are electrically connected by screwing the nut to the screw projection. Hence, in a case where the conductive plate is connected electrically to a pertinent electric circuit in advance, by only screwing the nut to the screw projection, the antenna signal of the antenna element can be communicated with the electric circuit.

Here, it is further preferable that the washer and the second insulative member are fixed the shield case, and the conductive plate is fixed to the second insulative member. The nut comprises a pair of flanges separated from each other in an axial direction of the screw projection, between which the conductive plate is interposed.

In such a configuration, since the nut is not separated from the conductive plate, the washer, the shield case, the second insulative member, the conductive plate and the nut, which are assembled with the vehicle body from the inside thereof are interconnected with each other. Accordingly, the workability of the mounting operation of the antenna device can be enhanced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

An antenna device 10 according to one embodiment of the invention will be described below in detail with reference to the accompanying drawings.

Figure 1:
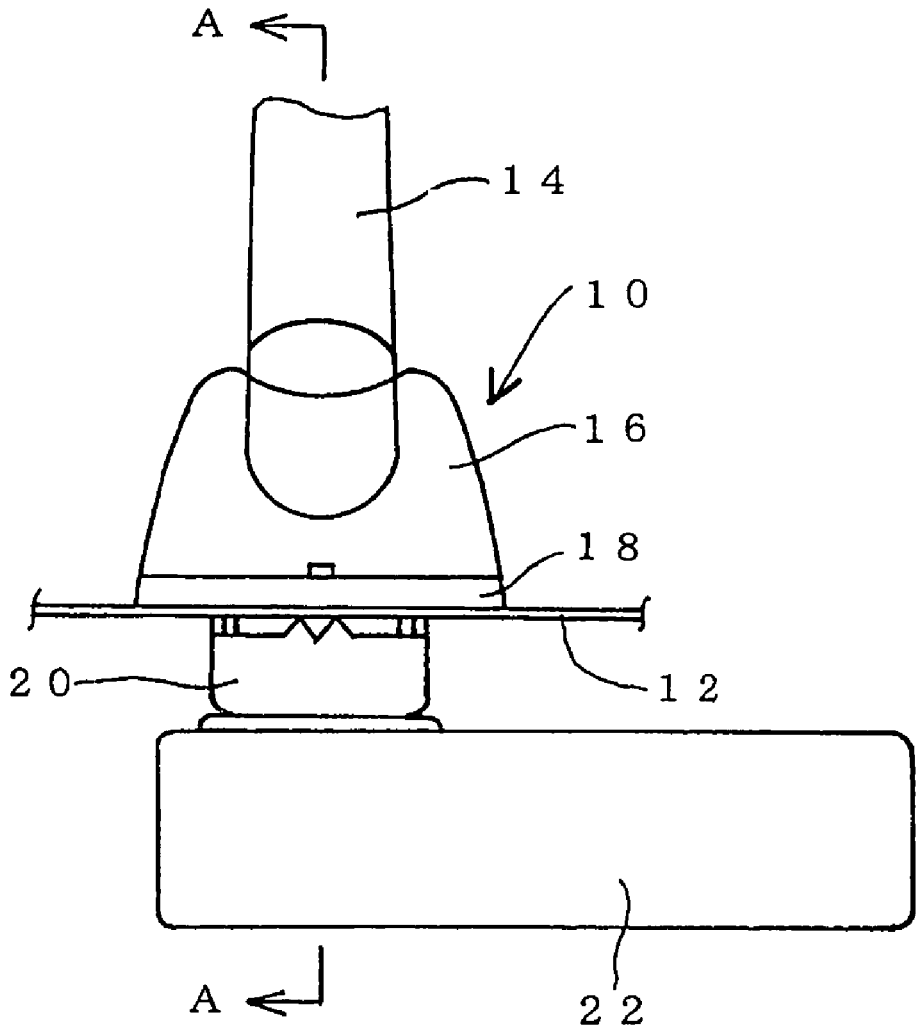
FIG. 1 is a front view of an essential portion of an antenna device according to one embodiment of the invention.
Figure 2:
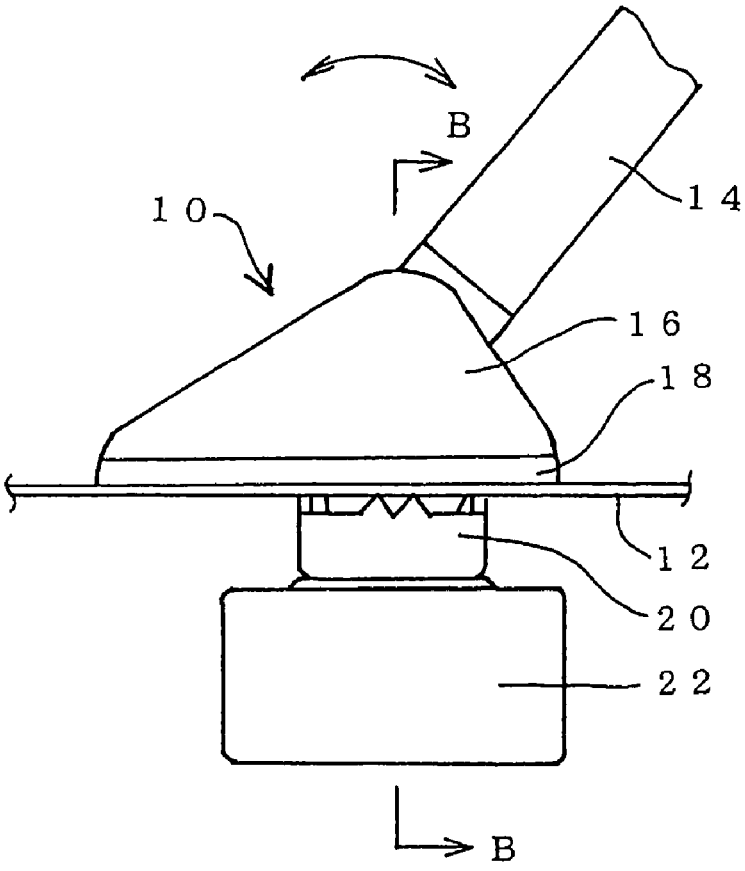
FIG. 2 is a right side view of FIG. 1.

As shown in FIGS. 1 and 2, the antenna device 10 is fixed to a roof 12 of a vehicle such that a pivotable antenna element 14, a cover 16 and a rubber pad 18 are provided in an outer side of the vehicle, and a pawl washer 20 and a shield case 22 are provided in an inner side of the vehicle.

Figure 3:
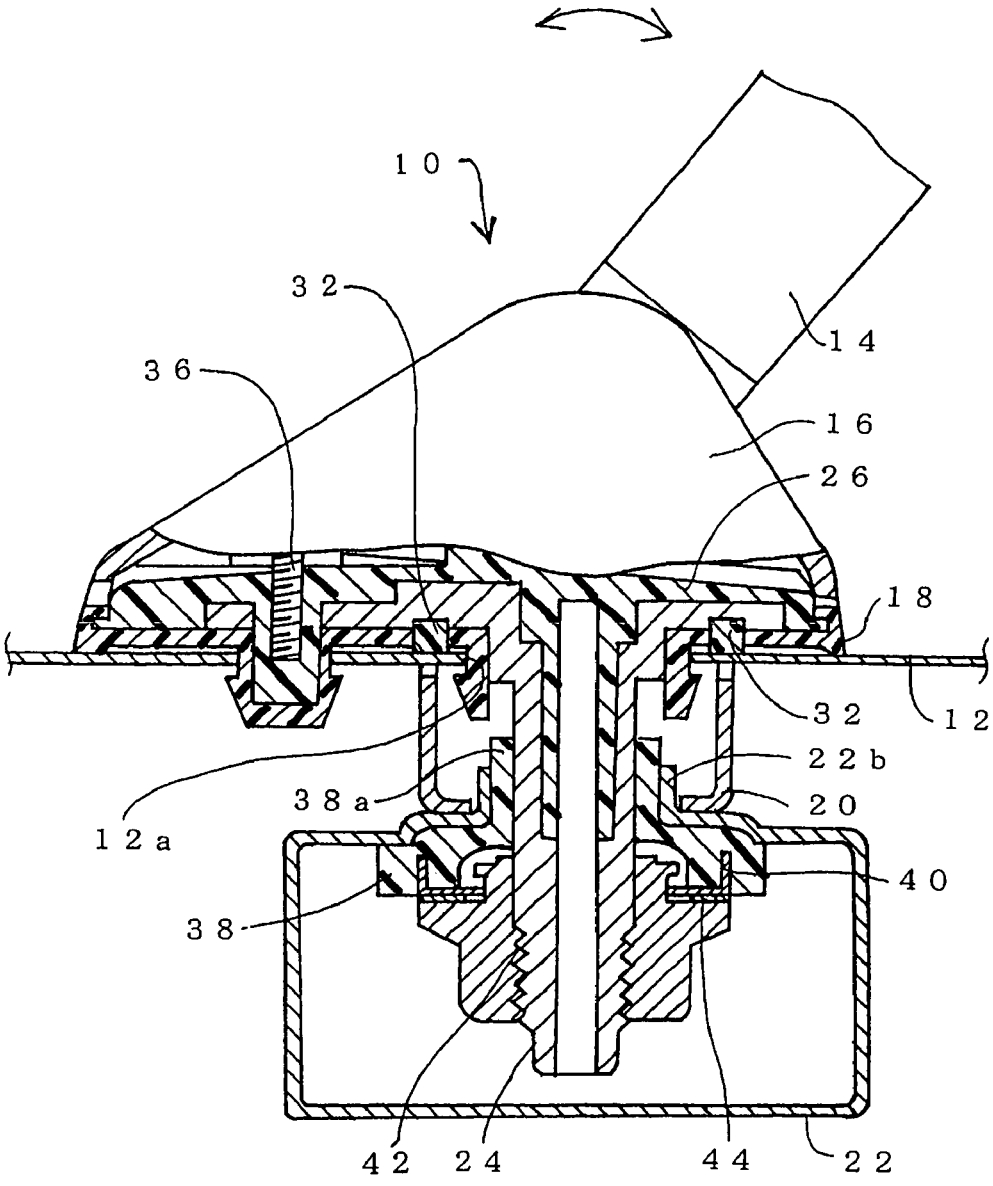
FIG. 3 is an enlarged sectional view taken along a line A—A of FIG. 1.
Figure 4:
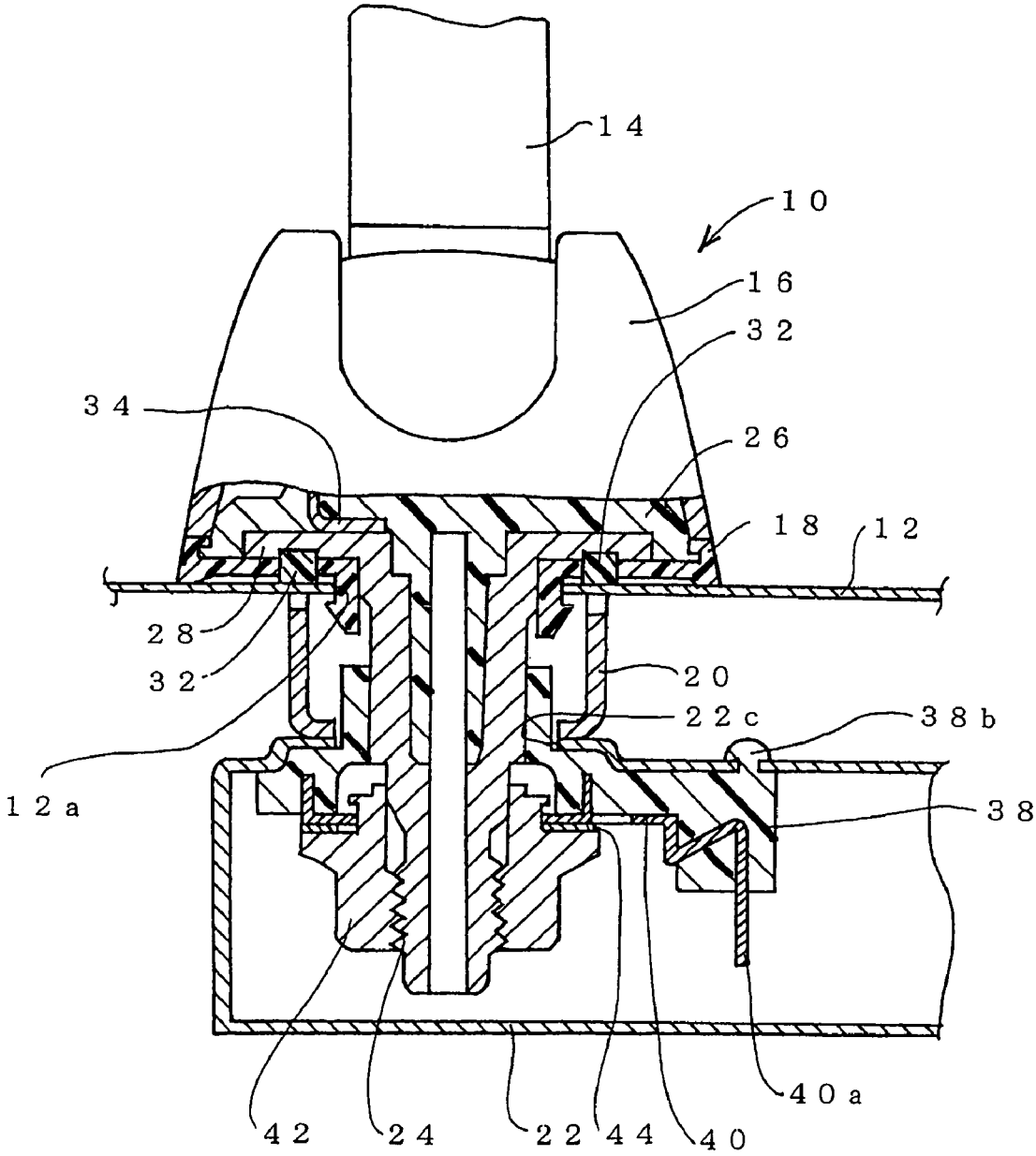
FIG. 4 is an enlarged sectional view taken along a line B—B of FIG. 2.

As shown in FIGS. 3 and 4, an antenna base 26 in which a conductive mount screw 24 is projected from a lower side thereof is provided at the inside of the cover 16. The rubber pad 18 is sealingly interposed between a lower face of the antenna base 26 and the roof 12 to prevent rain water or the like from invading into the vehicle from a mount hole 12*a* bored at the roof 12.

Figure 5:
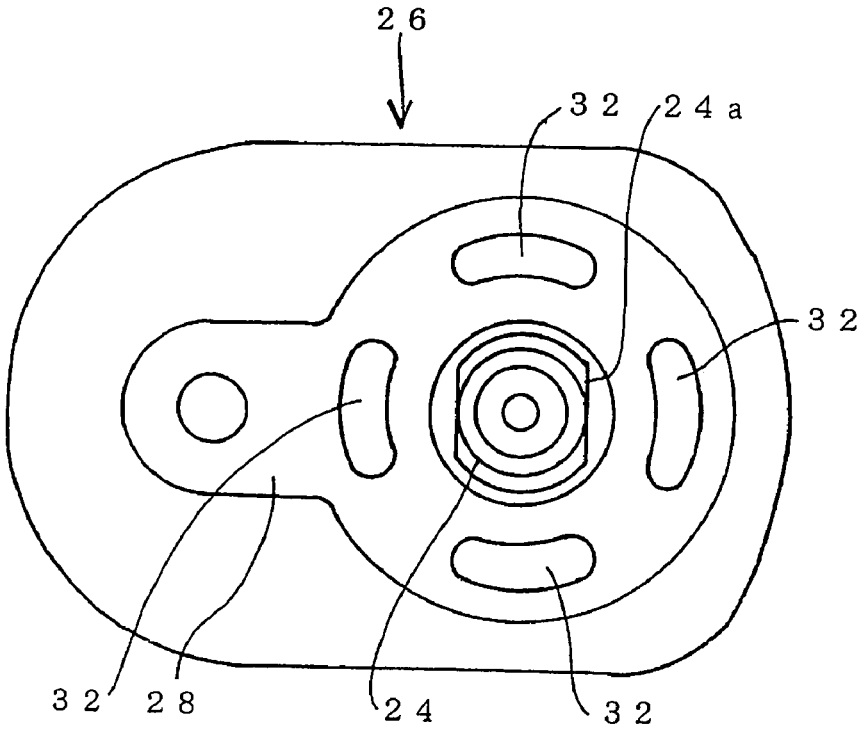
FIG. 5 is a bottom view of an antenna base of the antenna device.
Figure 9:
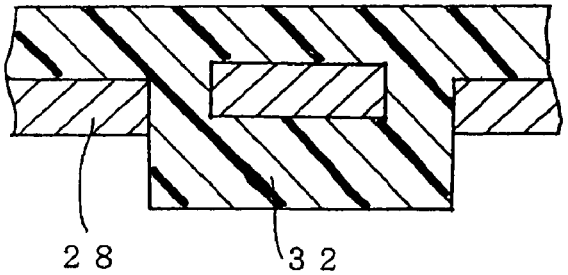
FIG. 9 is an enlarged sectional view taken along the line C—C of FIG. 7.
Figure 10:
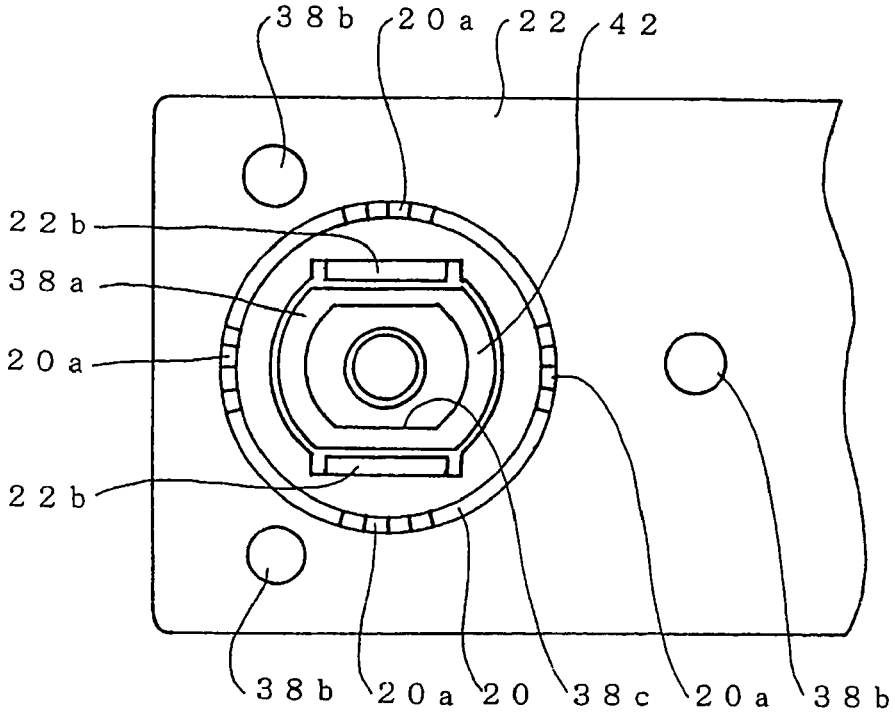
FIG. 10 is a plan view of a shield case of the antenna device showing a state that a pawl washer and an insulative retainer are fixed thereon.

The antenna base 26 is formed by subjecting a metal member 28 serving as a proximal end of the mount screw 24 (see FIG. 7) to an insert resin molding so as to have a bottom face shown in FIG. 5. The metal member is originally formed with through holes 30*a* concentrically with the mount screw 24 to form projection forming parts 30, so that insulating resin projections 32 are formed so as to project from the bottom face through the through holes 30*a* as shown in FIG. 9, when the insert resin molding is performed.

The antenna element 14 is pivotably fixed on the antenna base 26 through a not-shown mechanism. A proximal end of the antenna element 14 is electrically connected to the metal member 28 via a conductive piece 34.

Figure 7:
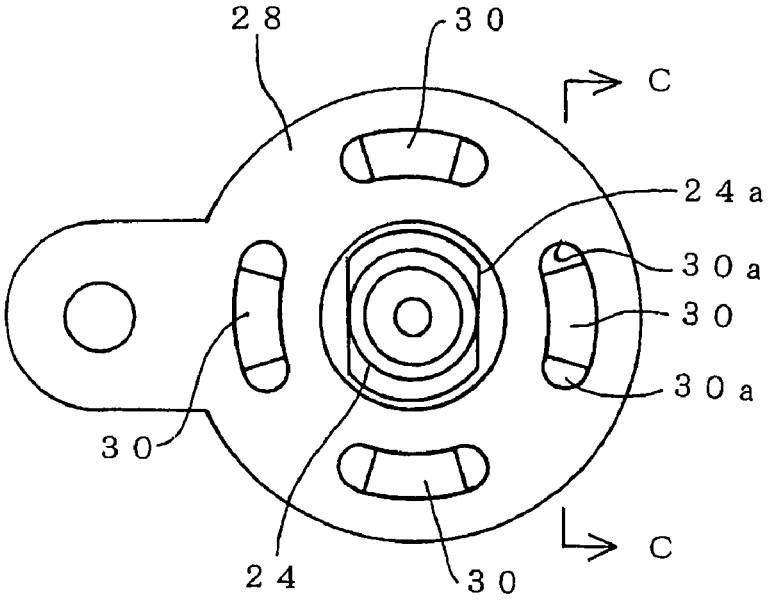
FIG. 7 is a bottom view of a metal member of the antenna device showing a state that the metal member is integrally molded with resin.
Figure 8:
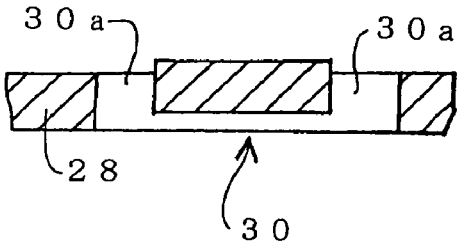
FIG. 8 is an enlarged sectional view of the metal member taken along a line C—C of FIG. 7.

As shown in FIGS. 5 and 7, a rotation stopper 24*a* is formed at the proximal end of the mount screw 24. The cross sectional shape in the direction perpendicular to the axial direction of the mount screw 24 is not limited to the shape shown in these figures only if the rotation stopping function (described later) is established.

The cover 16 is pertinently fixed to the antenna base 26 by a pan-head rivet, an engaging pawl or the like, which are not illustrated.

Figure 6:
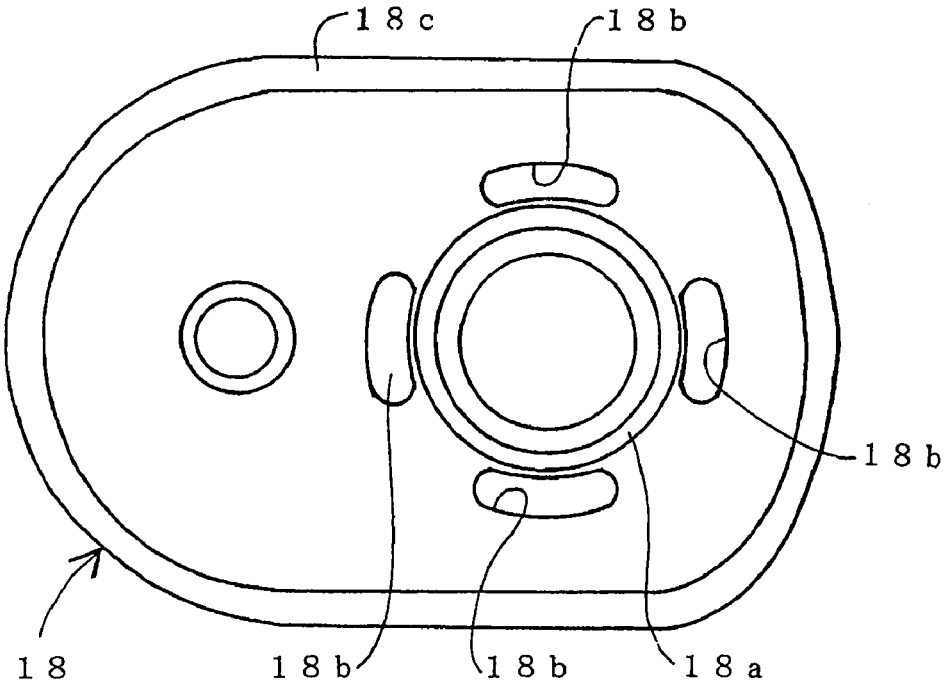
FIG. 6 is a bottom view of a rubber pad of the antenna device.

As shown in FIG. 6, the rubber pad 18 is formed with a cylindrical projection 18*a*. The mount screw 24 is inserted into the cylindrical projection 18*a*, and the cylindrical projection 18*a* is inserted into the mount hole 12*a* of the roof 12, so that electrical insulation is established between the roof 12 and the mount screw 24. Further, the rubber pad 18 is formed with through holes 18*b*, through which the insulating projections 32 of the antenna base 26 are inserted, so that the insulating projections 32 are brought into direct contact with the roof 12. A marginal projection 18*c* is formed on an marginal edge of a lower face of the rubber pad 18, and is brought into sealing contact with the roof 12.

Figure 11A:
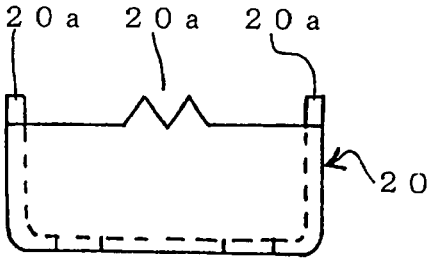
FIG. 11A is a side view of the pawl washer.
Figure 11B:
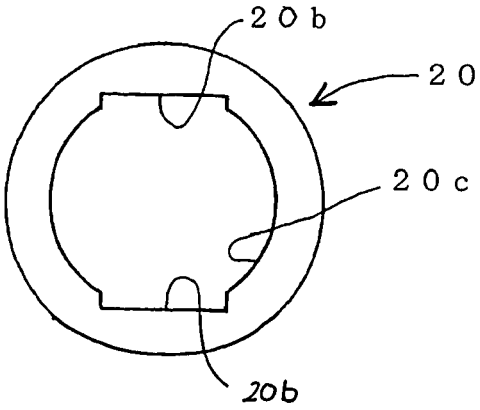
FIG. 11B is a bottom view of the pawl washer.

As shown in FIG. 11A, the pawl washer 20 is shaped into a bottomed cylinder. Pawls 20*a* are formed on an upper end of a cylindrical wall of the pawl washer 20 so as to oppose the insulating projections 32 of the antenna base 26. As shown in FIG. 11B, a hole 20*c* having notched portions 20*b* is formed at a bottom of the pawl washer 20. On the other hand, pawls 22*b* are provided at an edge of a hole 22*a* formed at an upper face of the shield case 22 into which the mount screw 24 is inserted. The pawls 22*b* are pertinently engaged with the notched portions 20*b* in order to integrate the pawl washer 20 and the shield case 22. Since the pawl washer 20 and the shield case 22 are conductive members, electrical connection therebetween is established. At least a wall of the shield case 22 where is arranged below the mount screw 24 is configured so as to be opened/closed.

Figure 12A:
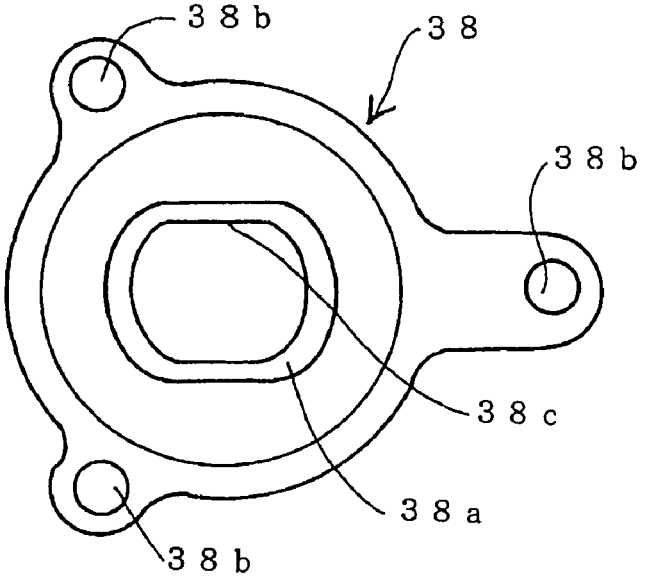
FIG. 12A is a plan view of the insulative retainer.
Figure 12B:
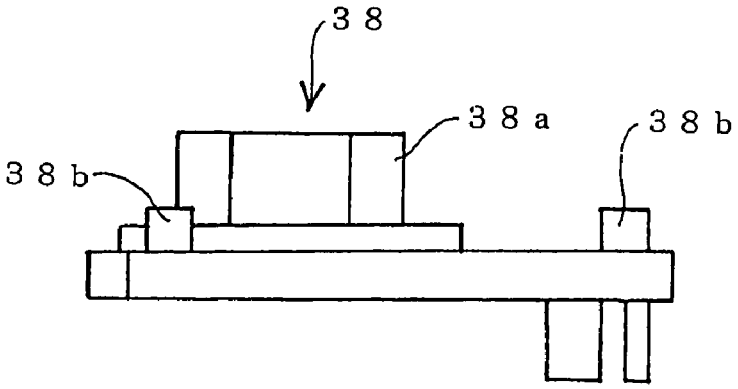
FIG. 12B is a side view of the insulative retainer.

An insulative retainer 38 shown in FIGS. 12A and 12B is disposed inside the shield case 22 such that a cylindrical portion 38*a* is projected upward through the hole 22*a*. The insulative retainer 38 is formed with thermal calking projections 38*b*, which are to be inserted into calking holes formed in the shield case 22 and thermally calked so that the insulative retainer 38 is fixed at an inner face of the top wall of the shield case 22. Further, the insulative retainer 38 is formed with a rotation stopper hole 38*a* having a shape corresponding to the cross sectional shape of the rotation stopper 24*a* of the mount screw 24. The shape of the rotation stopper hole 38*a* is not limited to that shown in the figures only if the rotation stopper 24*a* and the hole 38*a* cannot be rotated relative to each other.

A conductive plate 40 is pertinently fixed to the insulative retainer 38. A conductive nut 42 is coupled with the conductive plate 40 such that the nut 42 and the conductive plate 40 are rotatable relative to each other around an axis of the mount screw 24, and such that the nut 42 is movable in the axial direction of the mount screw by a predetermined length. For example, as shown in FIGS. 3 and 4, the nut 42 is formed with a pair of flanges spaced from each other by the predetermined length, between which the conductive plate 40 is disposed.

One end of the conductive plate 40 is electrically connected with a circuit board (not shown), on which an antenna circuit is mounted, disposed inside the shield case 22 to serve as a signal terminal 40*a*.

A conductive wave washer 44 is interposed between the conductive plate 40 and the nut 42, so that the conductive plate 40 is fastened between the insulative retainer 38 and the nut 42 through the wave washer 44 while establishing electrical connection between the conductive plate 40 and the nut 42.

According to the above-described configuration, the shield case 22, the pawl washer 20, the insulative retainer 38, and the nut 42 are integrated.

How to mount the above antenna device onto the vehicle body will be described.

First, from the outside of the vehicle body, the mount screw 24 and the cylindrical projection 18*a* of the rubber pad 18 is inserted into the hole 12*a* of the roof 12. The insulative projections 32 of the antenna base 26 are brought into contact with the roof 12 while bringing the marginal projection 18*c* of the rubber pad into intimate contact with the roof 12.

Next, from the opened lower wall of the shield case 22, the insulative retainer 38 is attached to the mount screw 24 projected downward from the inner face of the roof 12. Incidentally, the pawl washer 20 is arranged such that the pawls 20*a* are opposed to the insulative projections 32, so that the roof 12 is fastened by the insulative projections 32 and the pawls 20*a* when the nut 42 is screwed to the mount screw 24. After screwing the nut 42, the lower wall of the shield case is closed.

Incidentally, the shield case 22 is grounded to the roof 12 via the pawl washer 20. Since the mount screw 24 is electrically insulated from the shield case 22 and the pawl washer 20 by the insulative retainer 38, it is established a coaxial structure in which the mount screw 24 serves as a core conductor while the pawl washer 20 serves as an outer conductor. The mount screw 24 is electrically connected to the conductive plate 40 via the nut 42, so that an antenna signal of the antenna element 14 is communicated with the circuit board via the conductive plate 40.

In a state that the antenna device 10 is fixed to the roof 12, since the lower face of the metal member 28 of the antenna base 26 opposes the roof 12 through the rubber pad 18, a capacitor is formed between the roof 12 and the metal member 28. There is probability that the antenna signal is attenuated by the capacitor. In order to avoid such a situation, the metal member 28 is not formed entirely on the bottom face of the antenna base 26, but is formed partially in the vicinity of the projection forming parts 30 to reduce the area opposing the roof 12.

Similarly, since the flange of the nut 42 and the conductive plate 40 oppose the shield case 22, there is probability that a capacitor is formed between the signal path and the ground. In order to reduce the capacitance between the conductive plate 40 and the shield case 22, the dimension of the conductive plate 40 where establishes the electrical connection with the flange of the nut 42 is reduced so as to have substantially the same dimension of the flange of the nut 42. Further, projections are formed at an outer edge of the conductive plate 40 to be inserted into engagement grooves formed in the insulative retainer 38, thereby the conductive plate 40 is fixed to the insulative retainer 38.

According to the above-described configuration, since the mount screw 24 serves as the signal path of the antenna signal, the antenna device 10 is easily fixed to the roof 12 by screwing the nut 42 without providing any cable. Further, since the shield case 22, the pawl washer 20 and the nut 42 are integrally connected, the workability of the mounting operation can be enhanced.

Since it is established the coaxial structure in which the mount screw 24 serves as the core conductor and the pawl washer 20 serves as the outer conductor, it is possible to prevent external noise from mixing to the antenna signal.

Since the insulative projections 32 of the antenna base 26 oppose the pawls 20*a* of the pawl washer 20 through the roof 12, it is prevent the roof 12 from being advertently deformed.

Since the insulative projections 32 are integrally formed on the lower face of the metal member 28, the compressive force acting on the projections 32 when the fastening operation of the nut 42 is performed is received by the metal member 28. Since the shear stress does not act on the insulative projections 32, the mechanical strength of the insulative projections 32 can be enhanced.

Since the rubber pad 18 is not interposed between the insulative projections 32 and the roof 12, but the insulative projections 32 are brought into contact with the roof 12, the rubber pad 18 is not deformed by the fastening operation of the nut 42, thereby preventing rain water or the like from invading inside the vehicle body. Further, since the fastening pressure is directly received by the insulative projections 32, the fixation of the antenna device 10 can be secured.

Further, only by screwing the nut 42 to the mount screw 24, a signal path between the proximal end of the antenna element 14 and the circuit board or the like disposed inside the shield case 22 is established via the signal terminal 40*a* of the conductive plate 40.

In the conventional structure, since an amplifier for amplifying an antenna signal, a plexer for separating plural band signals or the like is disposed in a part provided on the outside of the roof 12, the size of the external part cannot be helped being increased. On the other hand, in antenna device 10 of the invention, the amplifier, the plexer or the like can be accommodated in the shield case 22. Therefore, the dimension of the part provided on the outside of the roof 12 can be downsized.

In this embodiment, although the antenna device 10 is fixed to the roof 12 of the vehicle, a mount hole may be bored to other outer wall of the vehicle such as a trunk and the antenna device may be fixed thereto. Further, the antenna element 14 may be arranged pertinently to the antenna base 26 depending on the mount position.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An antenna device mounted on a vehicle body, comprising:

an antenna element;

an antenna base, to which a distal end of the antenna element is attached, the antenna base comprising:

a conductive screw projection, electrically connected with the antenna element and inserted into a hole formed in the vehicle body;

a first insulative member, mounted on an outer face of the vehicle body to electrically insulate the screw projection from the vehicle body;

a conductive washer, disposed inside the vehicle body such that the screw projection is inserted therethrough;

a conductive nut, disposed inside the vehicle body to be screwed to the screw projection to form a conductive path between the antenna element and an electric equipment disposed inside the vehicle; and a second insulative member, disposed inside the vehicle body to electrically insulate the screw projection from the washer, and to electrically insulate the nut from the washer.

2. The antenna device as set forth in claim 1, wherein: the screw projection is inserted through the washer such that relative rotation therebetween is restricted;

the first insulative member comprises a projection brought into contact with the outer face of the vehicle body; and the washer comprises a pawl arranged so as to oppose the projection through the vehicle body.

3. The antenna device as set forth in claim 1, further comprising a conductive shield case having a wall interposed between the washer and the second insulative member and formed with a hole into which the screw projection is inserted, wherein:

the washer and the shield case are electrically connected;

the nut is screwed to the screw projection at the inside of the shield case; and the screw projection and the shield case are electrically insulated by the second insulative member.

4. The antenna device as set forth in claim 2, wherein the antenna base comprises a conductive member which is continuous with the screw projection and integrally molded with the first insulative member such that the projection is arranged between the conductive member and the vehicle body.

5. The antenna device as set forth in claim 3, wherein: the second insulative member is formed with a hole into which the screw projection is inserted; and the screw projection and the hole of the second insulative member are so formed as to restrict relative rotation therebetween.

6. The antenna device as set forth in claim 3, further comprising a conductive plate held by the second insulative member and the nut.

7. The antenna device as set forth in claim 6, wherein: the washer and the second insulative member are fixed the shield case, and the conductive plate is fixed to the second insulative member; and the nut comprises a pair of flanges separated from each other in an axial direction of the screw projection, between which the conductive plate is interposed.

8. The antenna device as set forth in claim 2, wherein the first insulative member comprises a rubber pad mounted on the outer face of the vehicle body and formed with a hole, through which the projection extends.

9. The antenna devices set forth in claim 1, wherein the hole is formed in a conductive part of the vehicle body.

* * * * *